US007896015B2

(12) United States Patent
Milano, Jr. et al.

(10) Patent No.: US 7,896,015 B2
(45) Date of Patent: Mar. 1, 2011

(54) PORTABLE SHELTER STRUCTURE

(75) Inventors: Arthur J. Milano, Jr., Burlington, CT (US); James Grevas, Oakville, CT (US)

(73) Assignee: Shelterlogic LLC, Watertown, CT (US)

( * ) Notice: Subject to any disclaimer, the term of this patent is extended or adjusted under 35 U.S.C. 154(b) by 232 days.

(21) Appl. No.: 11/869,026

(22) Filed: Oct. 9, 2007

(65) Prior Publication Data

US 2009/0090408 A1 Apr. 9, 2009

(51) Int. Cl.
*E04H 15/04* (2006.01)
*E04H 15/64* (2006.01)
*E04H 15/58* (2006.01)

(52) U.S. Cl. ..... 135/90; 135/117; 135/143; 135/119

(58) Field of Classification Search ..... 135/88.01, 135/138, 143, 144, 114, 115, 117, 119, 120.3, 135/98, 16; 108/50.12
See application file for complete search history.

(56) References Cited

U.S. PATENT DOCUMENTS 3,221,756 A 12/1965 Rupright
3,233,618 A 2/1966 Ferrier
3,383,127 A 5/1968 Grunfeld
3,417,764 A 12/1968 Hemenway
4,131,380 A * 12/1978 De Bliquy ..... 403/217
4,724,882 A * 2/1988 Wang ..... 160/69
4,779,635 A 10/1988 Lynch
5,050,900 A 9/1991 Lee
5,638,853 A 6/1997 Tsai
5,660,425 A * 8/1997 Weber ..... 296/163
5,701,923 A 12/1997 Losi, Jr. et al.
6,035,877 A 3/2000 Losi, Jr. et al.
6,287,042 B1 * 9/2001 Eriksson ..... 403/267
6,866,054 B1 3/2005 Collins
7,044,146 B2 5/2006 Losi, Jr.
2004/0216419 A1 11/2004 Sy-Facunda

FOREIGN PATENT DOCUMENTS

WO WO 2004/076778 A2 9/2004

* cited by examiner

*Primary Examiner* — David Dunn
*Assistant Examiner* — Danielle Jackson
(74) *Attorney, Agent, or Firm* — Carmody & Torrance LLP

(57) ABSTRACT

A portable shelter for providing cover over an area, wherein the shelter is coupleable to a structure, the portable shelter comprising a first base member and a second base member, each of which are coupleable to the structure; two subframe assemblies, each subframe assembly comprising a vertical support member having a first end and a second end, wherein the first end is coupleable to a respective base member, at least two arm members, each having a first end and a second end, wherein the first end of each respective arm member is pivotally coupled to the second end of vertical support member, at least two brace members, each having a first end and a second end, each respective first end being coupled to the vertical support member and each respective second end being pivotably coupled to a respective arm member, a first coupling arrangement for pivotably coupling the respective first end of each arm member to the second end of the vertical support member, a second coupling arrangement, slideably coupled to the vertical support member, for coupling the respective first end of each brace member to the vertical support member; and a canopy supporting assembly coupled to the two subframe assemblies, wherein the canopy supporting assembly supports a canopy and provides cover over the area.

4 Claims, 10 Drawing Sheets

PORTABLE SHELTER STRUCTURE

BACKGROUND OF THE INVENTION

The present invention relates generally to portable shelter structures, and in particular, to an improved shelter structure for use in a variety of applications, such as, to provide shade to a picnic table, a grandstand or to a flatbed, just to name a few examples. As will be disclosed below, the present invention is highly advantageous for its versatility in construction and applications to which it can be put to use.

Portable type table top tents and similar awning constructions are known in the art, such as from U.S. Pat. Nos. 3,233,618; 3,383,127; 3,417,764 and 6,866,054. However, each of the foregoing constructions have what are perceived as drawbacks.

As such, it is believed that further advances in the art are desirable. It is believed that the present invention overcomes the aforementioned deficiencies and provides advantages and achieves objectives disclosed herein.

SUMMARY AND OBJECTIVES OF THE PRESENT INVENTION

It is thus an objective of the present invention to overcome the perceived deficiencies in the prior art.

For example, it is an objective of the present invention to provide an improved portable shelter structure that can be mounted and orientated to be coupled on and/or to a variety of structures, such as for example and not limitation, a picnic table, a grandstand and a tailgate of a truck.

It is yet another objective of the present invention to provide an improved portable shelter structure that allows for relatively quick assembly and disassembly, while at the same time, achieving the other objectives set forth herein.

Yet another objective of the present invention is to provide an improved portable shelter structure that is both easy to utilize and manufacture and also that achieves all of the advantages and objectives set forth herein.

For example, it is an objective of the present invention to provide an improved portable shelter structure that can be both transported and assembled easily in view of the construction of the canopy supporting assembly, which comprises one or more pole and/or pole assemblies.

Yet another objective of the present invention to provide an improved portable shelter structure that has improved vertical adjustability and canopy features.

Still another objective of the present invention is to provide a portable shelter structure that provides for an improved canopy construction which permits an easier shelter construction as well as an improved design to receive and secure the poles therein.

And yet another objective of the present invention is to provide an improved portable shelter structure that achieves the objective of providing an adjustable amount of shelter (e.g. cover) next to or otherwise proximate the structure to/on which it is mounted or (e.g.) coupled. For example, the present invention is constructed so as to provide adjustability of positioning of the canopy to extend over/next to the structure itself, thereby providing shelter for a baby carriage and/or food items, just to name a few examples that may be positioned next to the structure.

Still further another objective of the present invention is to provide an improved portable shelter structure that can be mounted or coupled to structures of varying sizes, such as for example and not limitation, picnic tables of many sizes, such as those 6 feet in length, 10 feet in length, and 12 feet in length, although it is understood that the adjustability can easily accommodate additional lengths as the aforementioned examples are provided only because of the standardization of the tables and not any limitation of the present invention.

Further objects and advantages of this invention will become more apparent from a consideration of the drawings and ensuing description.

The invention accordingly comprises the features of construction, combination of elements, arrangement of parts and sequence of steps which will be exemplified in the construction, illustration and description hereinafter set forth, and the scope of the invention will be indicated in the claims.

To overcome the perceived deficiencies in the prior art and to achieve the objects and advantages set forth above and below, the present invention is, generally speaking, directed to a portable shelter for providing cover over an area, wherein the shelter is coupleable to a structure, the portable shelter comprising a first base member and a second base member, each of which are coupleable to the structure; two subframe assemblies, each subframe assembly comprising a vertical support member having a first end and a second end, wherein the first end is coupleable to a respective base member, at least two arm members, each having a first end and a second end, wherein the first end of each respective arm member is pivotally coupled to the second end of vertical support member, at least two brace members, each having a first end and a second end, each respective first end being coupled to the vertical support member and each respective second end being pivotably coupled to a respective arm member, a first coupling arrangement for pivotably coupling the respective first end of each arm member to the second end of the vertical support member, and a second coupling arrangement, slideably coupled to the vertical support member, for coupling the respective first end of each brace member to the vertical support member; and a canopy supporting assembly coupled to the two subframe assemblies, wherein the canopy supporting assembly supports a canopy and provides cover over the area.

BRIEF DESCRIPTION OF THE DRAWINGS

The above set forth and other features of the invention are made more apparent in the ensuing Description of the Preferred Embodiments when read in conjunction with the attached Drawings, wherein:

FIG. 3 is a cross-sectional view of one of many inventive features of the present invention, namely the construction of the poles of the canopy supporting assembly, while

Identical reference numerals in the figures are intended to indicate like parts, although not every feature in every figure may be called out with a reference numeral.

DETAILED DESCRIPTION OF THE PREFERRED EMBODIMENTS

Figure 1:
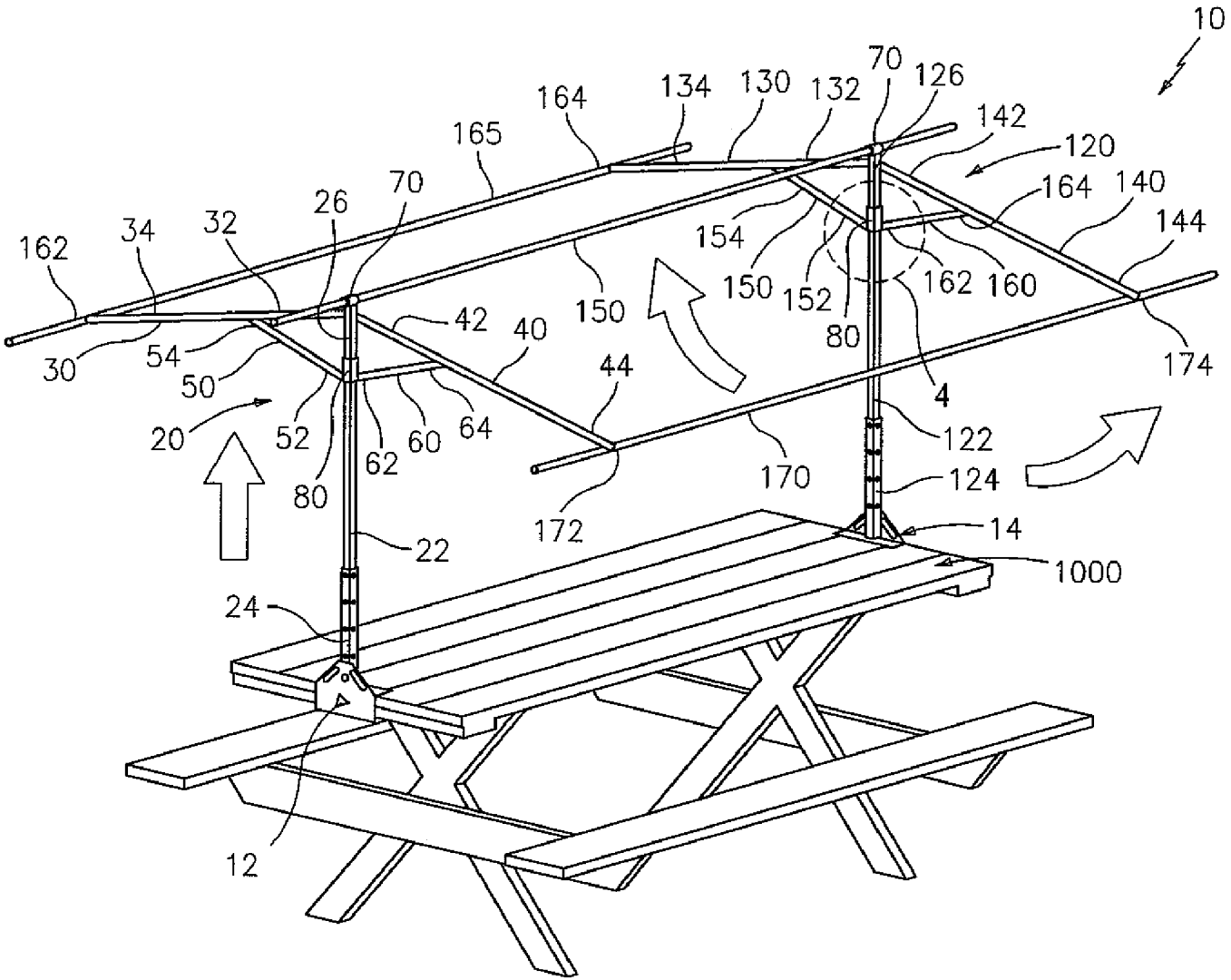
FIG. 1 is a simplified perspective view of a portable shelter structure constructed in accordance with a first embodiment of the present invention being coupled to a conventional structure (e.g. a picnic table)
Figure 5A:
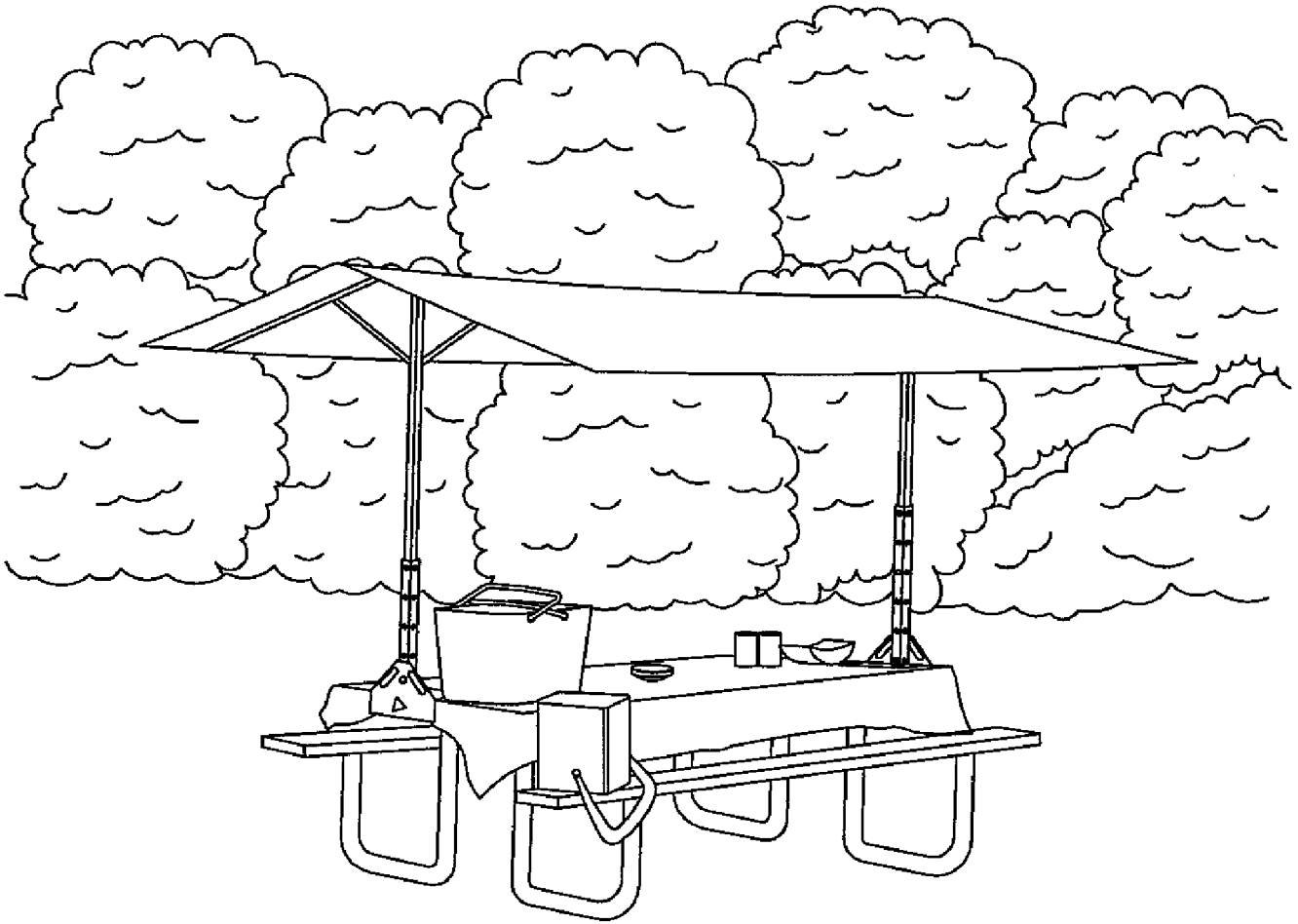
FIGS. 5A, 5B, 5C, 5D are perspective views showing the versatility and applicability of the present invention.
Figure 5B:
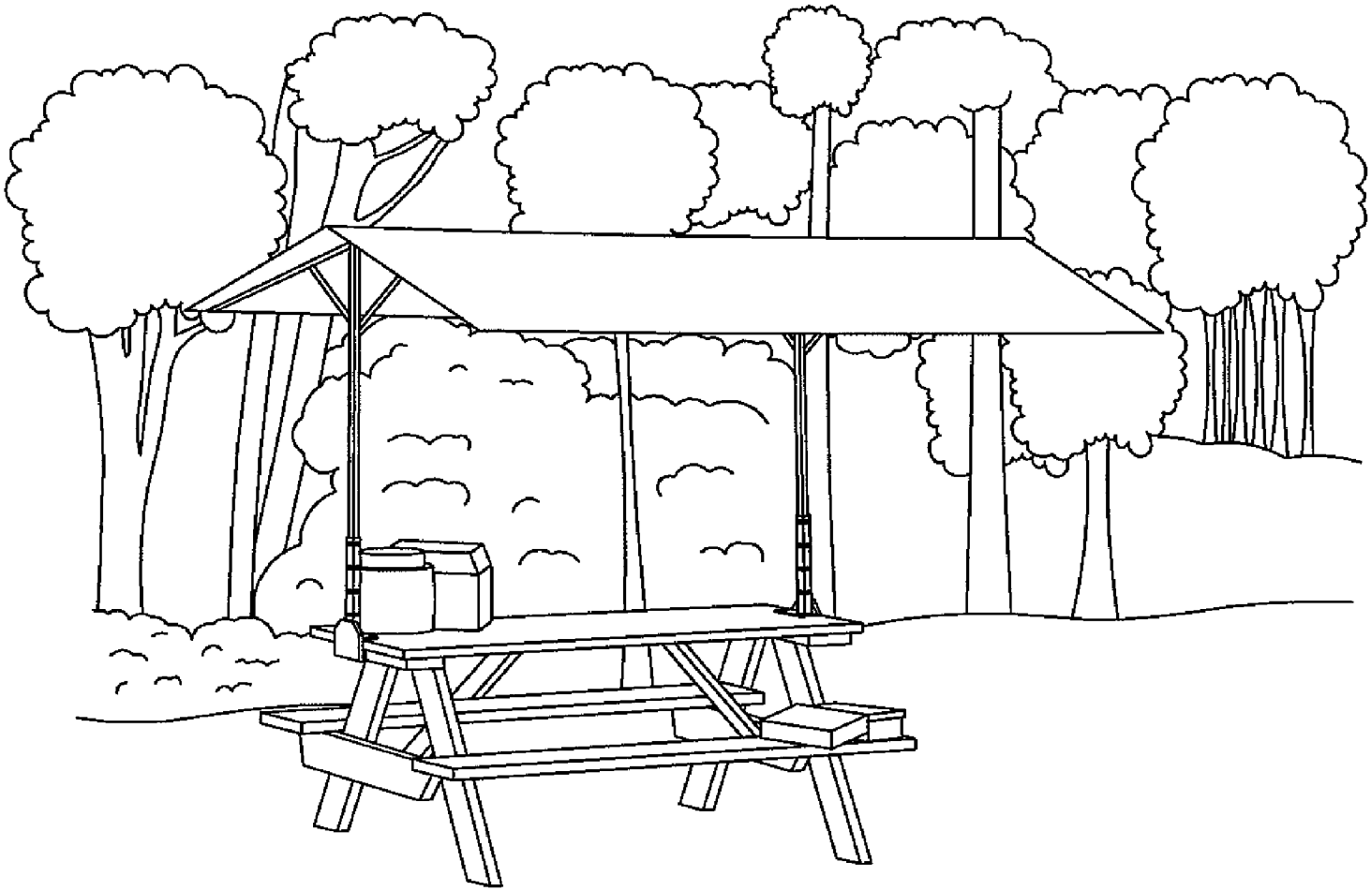
Figure 5C:
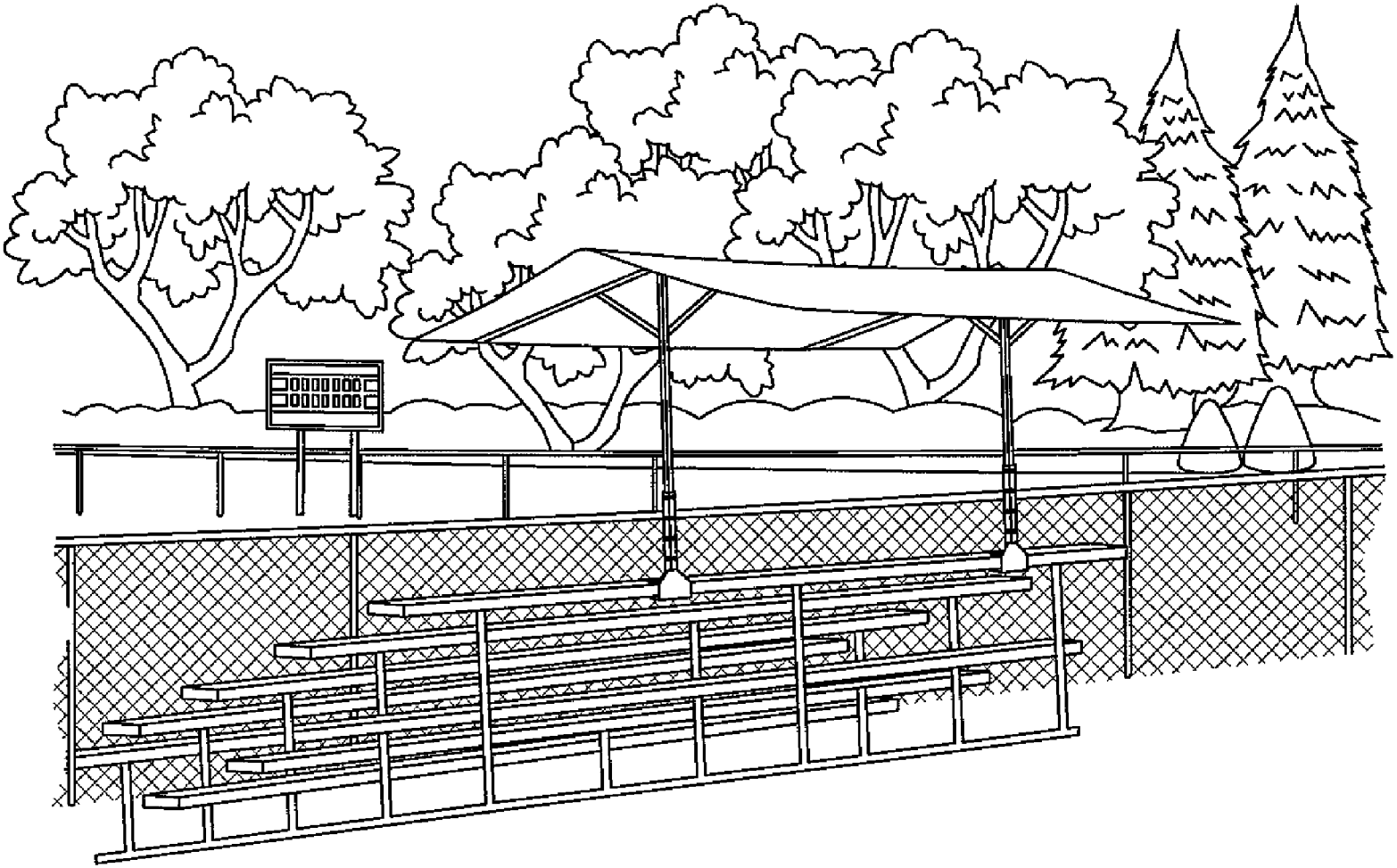
Figure 5D:
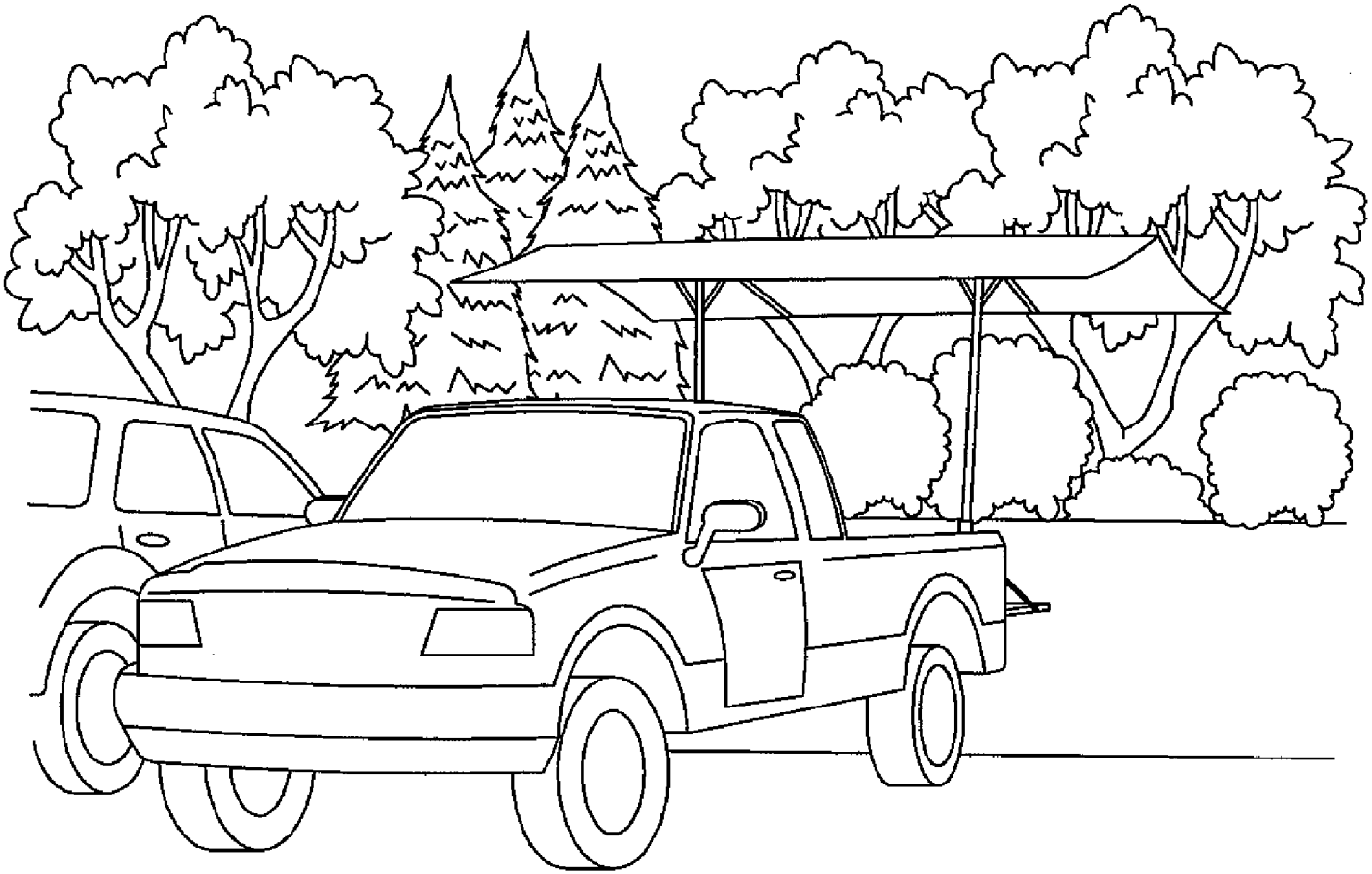

Reference is made to FIG. 1, which shows a portable shelter structure, generally indicated at 10, constructed in accordance with a first embodiment of the present invention. As disclosed above and will be appreciated by those reading the present disclosure, it will become readily apparent that the present invention is utilizable in connection with a variety of applications, such as but not limited to, providing shelter to a picnic table (FIGS. 1, 5A, 5B), providing shelter to a grandstand (FIG. 5C) and/or providing shelter over and/or near a truck's tailgate (FIG. 5D). As such, the present invention is believed to be more versatile than existing state of the art structures of a similar type.

As illustrated in FIG. 1 and generally speaking, a preferred embodiment of portable shelter 10 comprises a first base member, generally indicated at 12 and a second base member, generally indicated at 14, each of which are coupleable to the structure, which in the FIG. 1 example, is a picnic table, generally indicated at 1000. Specifically, and as illustrated in FIG. 1, both base member 12 and base member 14 are coupled to respective ends of table 1000. Details of members 12, 14 are disclosed further below.

This first preferred embodiment of the present invention provides that portable shelter 10 further comprises two subframe assemblies, generally indicated at 20, 120 respectively, both of which are preferably identical in many respects. For those features that are identical, reference may only be made to one of the subassemblies, i.e. subassembly 20, with the identical features existing in subassembly 120 being referenced in the parentheticals, shown in the figures and/or referred to elsewhere herein.

For example, each subframe assembly 20, 120 preferably comprises a vertical support member 22 (122) having a first end 24 (124) and a second end 26 (126), wherein the first end 24 (124) is coupleable to a respective base member 12 (14); at least two arm members 30, 40 (130, 140), each having a first end 32, 42 (132, 142) and a second end 34, 44 (134, 144), wherein the first end 32, 42 of each respective arm member 30, 40 is pivotally coupled to the second end 26 (126) of vertical support member 22 (122); at least two brace members 50, 60 (150, 160), each having a first end 52, 62 (152, 162) and a second end 54, 64 (154, 164), each respective first end 52, 62 (152, 162) being coupled to the vertical support member 22 (122) and each respective second end 54, 64 (154, 164) being pivotably coupled to a respective arm member 30, 40 (130, 140); a first coupling arrangement, generally indicated at 70, for pivotably coupling the respective first end 32, 42 (132, 142) of each arm member 30, 40 (130, 140) to the second end 26 of the vertical support member 22 (122); and a second coupling arrangement, generally indicated at 80, slideably coupled to the vertical support member 22 (122), for coupling the respective first end 52, 62 (152, 162) of each brace member 50, 60 (150, 160) to the vertical support member 22 (122).

Also in the preferred embodiment, portable shelter structure 10 comprises a canopy supporting assembly coupled to the two subframe assemblies 20, 120, wherein the canopy supporting assembly supports a canopy and provides cover over one or more areas as disclosed below.

Figure 2A:
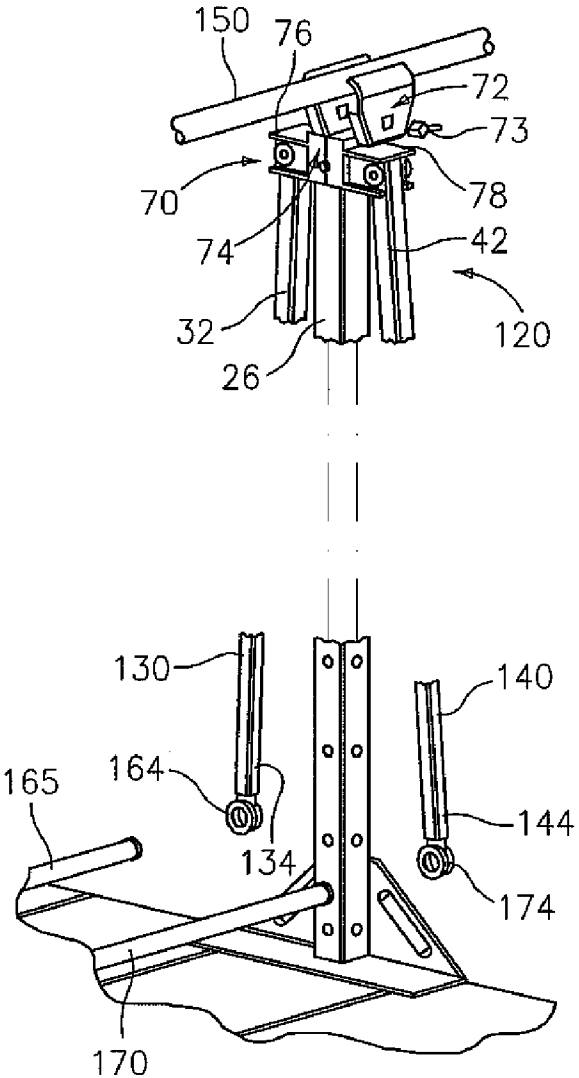
FIGS. 2 and 2A are also perspective views of the portable shelter structure constructed in accordance with a first embodiment of the present invention, with FIG. 2A being an enlargement of the highlighted section of FIG. 2.
Figure 2:
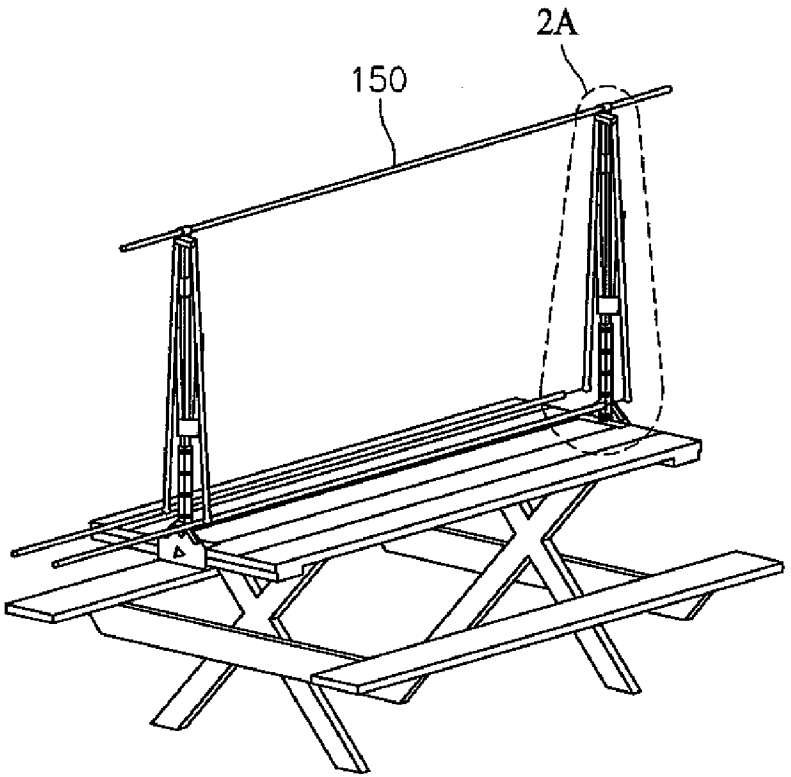

As illustrated in FIG. 2, canopy supporting assembly may comprise a variety of components. For example, canopy supporting assembly may comprise a backbone pole 150, and wherein the first coupling arrangement 70 of each subframe assembly 20, 120 comprises a clamp 72 for releasably securing an end of the backbone pole 150 to the respective subframe assembly. In the preferred embodiment, clamp 72 has two halves that are tightened by a screw (not shown) and nut 73 combination. In this way, the clamping of the backbone pole 150 by each respective clamp 72 assists in preventing the sliding of the backbone pole 150 through the respective clamps. Other advantages by use of this clamping arrangement are disclosed below.

As further illustrated in the figures, the canopy supporting assembly may comprise a first rib pole 165 and a second rib pole 170, as well as a first rib pole supporter 162 coupled to the second end 34 of the first arm member 30 of the first subframe assembly 20, a second rib pole supporter 164 coupled to the second end 134 of the first arm member 130 of the second subframe assembly 120, a third rib pole supporter 172 coupled to the second end 44 of the second arm member 40 of the first subframe assembly 20 and a fourth rib pole supporter 174 coupled to the second end 144 of the second arm member 140 of the second subframe assembly 120. In the preferred embodiment, all four rib pole supporters are inserted into the respective second ends of the arm members, which are preferably all comprised of hollow tubing. Additional locking means, such as screws/nuts can be used to further secure the rib pole supporters to the ends of the respective arm members. As such, the first rib pole 165 is supported by the first and second rib pole supporters 162, 164 and the second rib pole 170 is supported by the third and fourth rib pole supporters 172, 174. Clamping at the respective ends of the pole supporters are not needed, but can be provided if desired.

Figure 3:
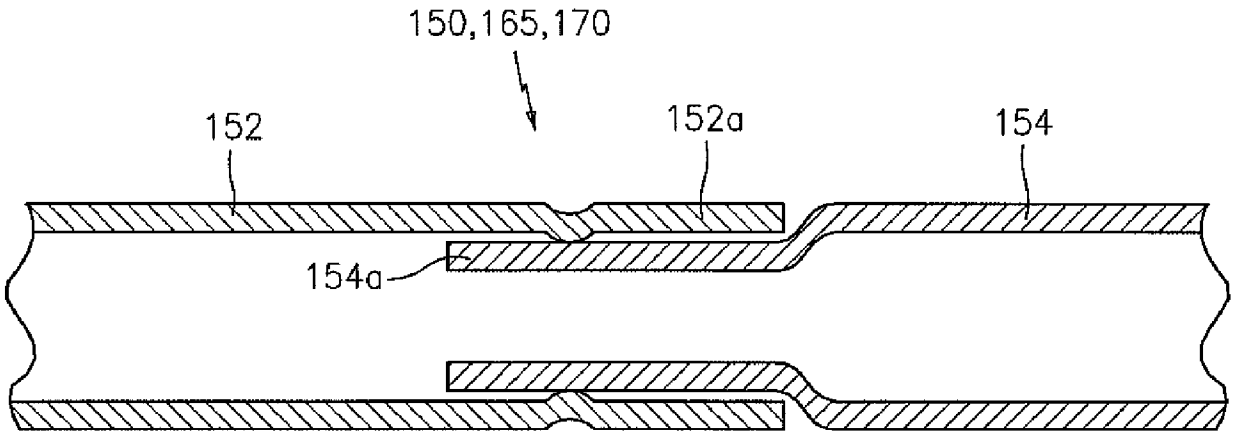

Reference is now additionally made to FIG. 3 which is an enlargement of one of the poles used in the present invention. As the inventive feature of FIG. 3 and hereinafter disclosed can be applicable to any of the poles, it should be considered that FIG. 3 illustrates the preferred embodiment of backbone pole 150, rib pole 165 and/or rib pole 170. Thus, while reference to FIG. 3 will be disclosed with reference to backbone pole F 150, it should be understood that FIG. 3 represents the preferred construction of each of the disclosed poles herein, namely backbone pole 150, rib pole 165 and/or rib pole 170. That is, in a preferred embodiment, at least one of the backbone pole 150, the first rib pole 165 and the second rib pole 170 is comprised of a plurality of components, including a first pole segment 152 and at least a second pole segment 154. The first pole segment 152 has a first end 152*a* dimensioned for receiving a swaged or tapered first end 154*a* of the second pole segment 154. To provide a desirable amount of increased friction fit while maintaining the ease by which the segments may be assembled and disassembled together, the first end 152*a* of the first pole segment 152 preferably has one or more dimples extending from the inner surface thereof to provide an increased friction fit with the second end 154*a* of the second pole segment 154 when inserted therein. The inner surface of first end 152*a* may also be provided with a ring 153 (which may be a full annular ring or only extend partially around) extending along the inner surface thereof to provide the desired friction fit. To be sure, FIG. 3 is intended to disclose a single dimple, a plurality of dimples and the aforementioned whole or partial ring. Again, this inventive dimple/ring feature provides adequate releasable friction fitting while also providing a sufficient ease in construction and deconstruction of the poles. Use of such segments instead of one continuous long pole facilitates shipping and transportation of the invention, and in particular, facilitates the packing, transport and construction of the present invention by users thereof (e.g. campers, event goers, picnic goers, etc.).

Figure 3A:
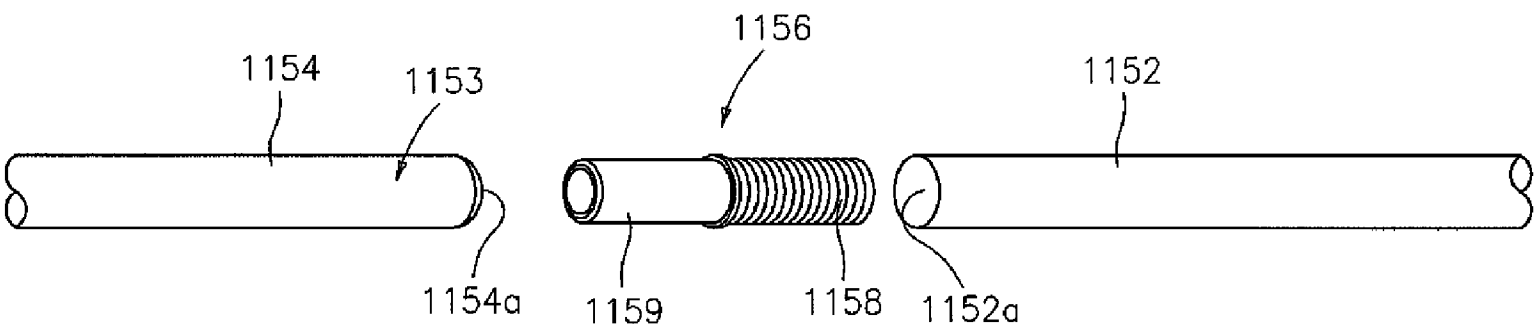
FIG. 3A is a perspective view of an alternative construction thereof.

Reference is now additionally made to FIG. 3A which shows an alternative embodiment of one of the poles used in the present invention. Likewise, the inventive feature of FIG. 3A and hereinafter disclosed can be applicable to any of the poles, it should be considered that FIG. 3A illustrates the preferred embodiment of backbone pole 150, rib pole 165 and/or rib pole 170. Thus, while reference to FIG. 3A will be disclosed with reference to backbone pole 150, it should be understood that FIG. 3A likewise represents a preferred construction of each of the disclosed poles herein, namely backbone pole 150, rib pole 165 and/or rib pole 170. That is, in this embodiment, at least one of the backbone pole 150, the first rib pole 165 and the second rib pole 170 is comprised of a plurality of components, including a first pole segment 1152, at least a second pole segment 1154, and a pole segment coupler 1156, which itself has a first end 1158 and a second end 1159, for coupling the first pole segment 1152 to the at least second pole segment 1154. The first pole segment 1152 has a first end 1152*a* dimensioned for receiving the first end 1158 of the pole segment coupler 1156 and the second pole segment 1154 has a first end 1154*a* dimensioned for receiving the second end 1159 of the pole segment coupler 1156. In this preferred embodiment, the first end 1158 of the pole segment coupler 1156 has a surface contoured to increase a friction fit with an inner surface of the first end 1152*a* of the first pole segment 1152. Such a surface contour is preferably a plurality of ribs spaced along the end thereof. This facilitates a good friction fit between the first end 1158 of the coupler 1156 and first end 1152*a* of pole segment 1152. In contrast, the first end 1154*a* of the second pole segment 1154 preferably has at least one dimple 1153 extending from the inner surface thereof to provide an increased friction fit with the second end 1159 of the pole segment coupler 1156 when inserted therein. Likewise, a plurality of dimples may be used, as could there be a ring (which may be a full annular ring or only extend partially around) extending from the inner surface thereof. To be sure, FIG. 3A is intended to disclose a single dimple, a plurality of dimples and the aforementioned whole or partial ring. Here too, this inventive dimple and/or ring feature likewise provides adequate releasable friction fitting while also providing a sufficient ease in construction and deconstruction of the poles. Here too, use of such segments instead of one continuous long pole facilitates shipping and transportation of the invention, and in particular, facilitates the packing, transport and construction of the present invention by users thereof (e.g. campers, event goers, picnic goers, etc.).

Although FIGS. 3 and 3A illustrate only two pole segments, it is envisioned that preferred embodiment may utilize poles, when completed, as long as 120 inches, thereby optimally constructing such poles from three (3) segments (of 40 inches each) and thus preferably (as in the case of the FIG. 3A embodiment) requiring two pole segment couplers. Poles of lengths other than 120" and 40" (as segments) are also within the purview of one skilled in the art. Adding a third pole segment (FIG. 3) and/or a second pole segment coupler to the pole assembly illustrated in FIG. 3A should be well within those skilled in the art in view of the foregoing disclosure with respect to the first two pole segments (FIG. 3) and the first pole segment coupler (FIG. 3A).

Returning briefly again to FIG. 2, it can be seen that each of the first coupling arrangements 70 preferably comprise a molded coupler 74, which may be integrally molded with one half of clamp 72. Coupler 74 is preferably made of polymer and can be secured (e.g. friction fitted) onto the second end 26 (126) of each vertical support member 22 (122). Again, a screw and nut combination can assist in maintaining the integrity of this connection. Coupler 74 has hands 76, 78 which respectively receive the respective first ends 32, 42 of arms 30 and 40. Preferably, an identical coupler 74 is provided on subframe assembly 120.

Each hand 76, 78 is comprised of opposing faces of the molded polymer between which the respective first ends, 32, 42 are positioned. Using a conventional screw/nut and/or washer arrangement (as shown), first ends 32, 42 can rotate within its respective hand, thereby providing the pivotable coupling of the respective first ends of each arm member to the respective second end 26 (126) of each respective vertical support member 22 (122).

Figure 4:
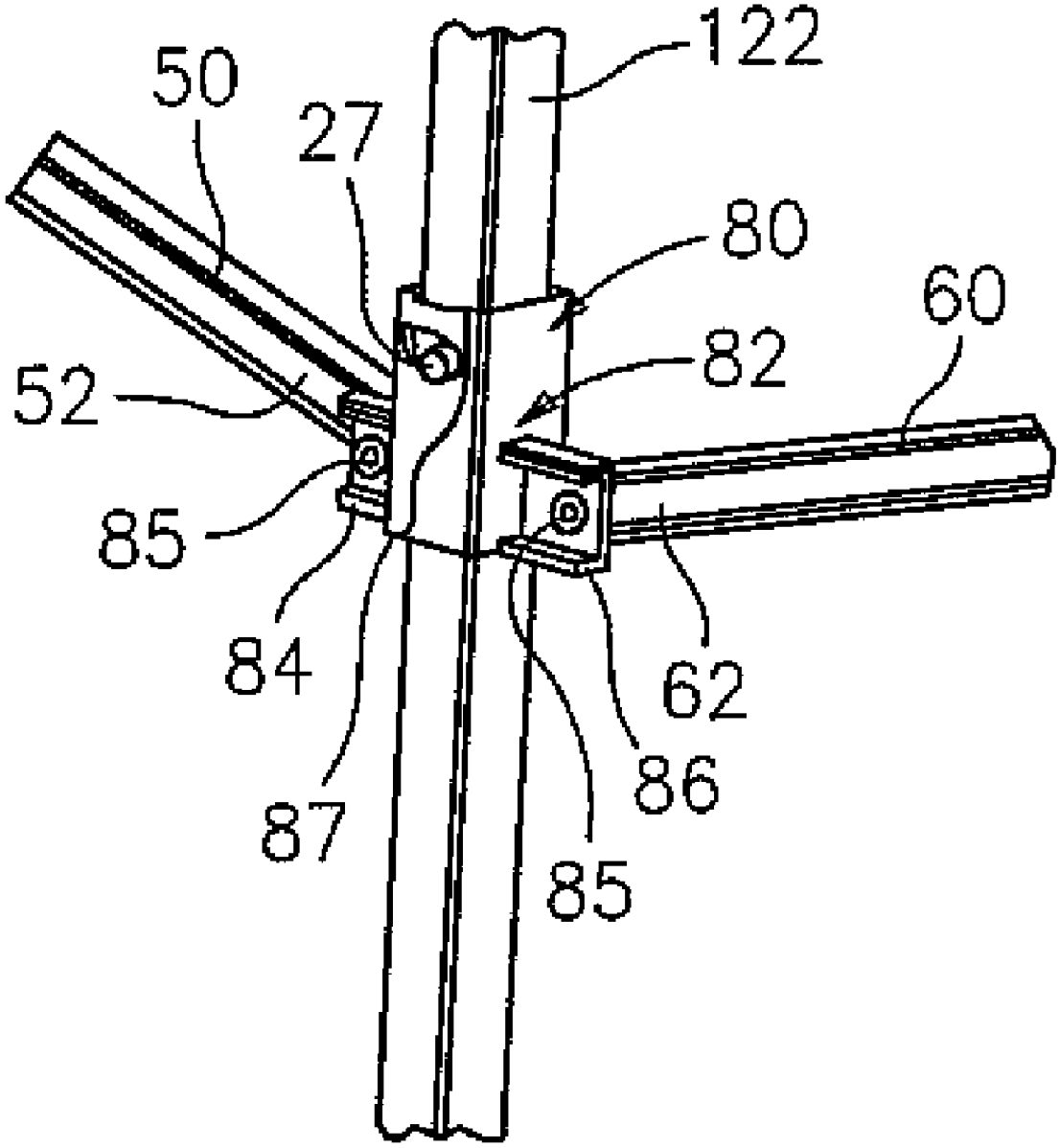
FIG. 4 is a perspective view of another aspect of the present invention, namely one of the coupling arrangements.

Reference is now made briefly to FIG. 4, wherein the second coupling arrangement 80 of each subframe assembly is disclosed in greater detail. Here, in the preferred embodiment, each coupling arrangement 80 preferably comprises a molded coupler 82, which is slideably positioned along the respective vertical support member 22 (122) and has coupled thereto the respective first ends 52, 62 (152, 162) of each brace member 50, 60 (150, 160). In the preferred embodiment coupler 82 has integrally molded hands 84, 86 which respectively couple to the respective first ends of each brace member 50, 60 (150, 160). Each hand 84, 86 is preferably secured to its respective brace member using conventional screw/nut and/or washer arrangements 85. In this way, first ends 52, 62 (152, 162) can rotate about its respective hand so that when the respective first ends 52, 62 of each brace member 50, 60 are coupled thereto and the respective second ends 54, 64 of each brace member 50, 60 are coupled to the respective arm member 30, 40 (i) the sliding of second coupling arrangement 80 towards the second end 26 of the vertical support member 22 results in the pivoting of the second ends 34, 44 of the respective arm members 30, 40 away from the vertical support member (i.e. towards an open position illustrated in FIGS. 1, 5A, 5B, 5C and 5D) and (ii) the sliding of second coupling arrangement 80 towards the first end 24 of the vertical support member 22 results in the pivoting of the second ends 34, 44 of the respective arm members 30, 40 towards the vertical support member (FIG. 2). In other words, the shelter structure 10 can open and can be shut. A similar construction and result is provided with respect to second subframe assembly 120.

Figure 6:
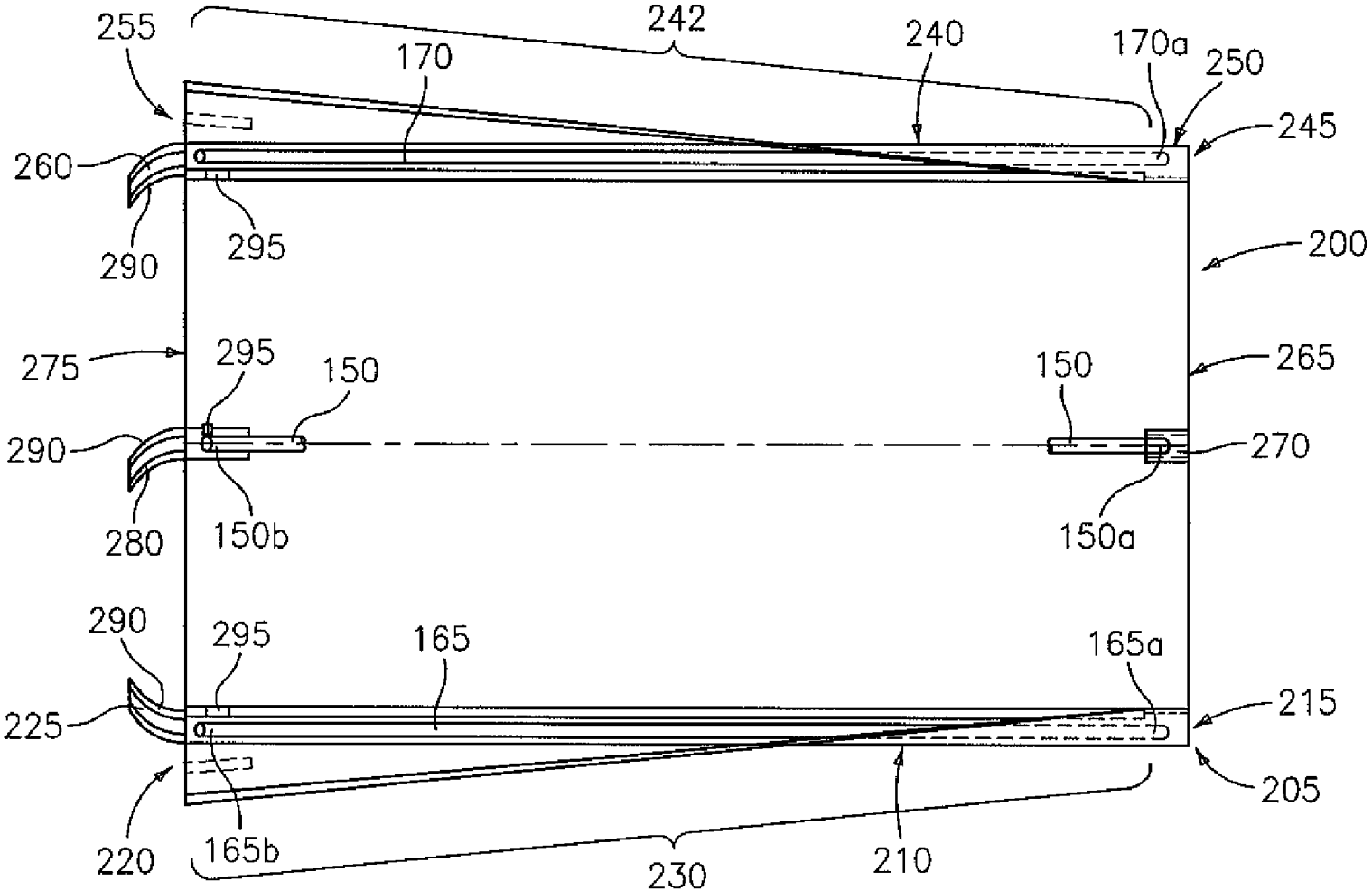
FIG. 6 is a perspective view of another of the many inventive aspects of the present invention, namely a preferred canopy construction.

As illustrated in FIGS. 5A, 5B, 5C, 5D the portable shelter 10 includes a canopy, generally indicated at 200 in FIG. 6. Canopy 200 is preferably at least substantially rectangular in shape. In accordance with a preferred embodiment, canopy 200 includes, at one corner 205 of a first end generally indicated at 210, a pocket 215 for receiving and trapping a first end 165*a* of the first rib pole 165; at the other corner 220 of the first end 210, an open and closable pocket created in part by flap 225 for facilitating the receiving and releasable trapping of a second end 165*b* of the first rib pole 165 and along substantially the remainder of the first end 210, an enclosure 230 for enclosing at least a substantial length of the first rib pole therein 165.

In the preferred embodiment, along the second end 240 of canopy 200 is an identical construction. That is, at one corner 245 of the second end generally indicated at 240 is a pocket 250 for receiving and trapping a first end 170*a* of the second rib pole 170; at the other corner 255 of the second end 240 is also an open and closable pocket created in part by a flap 260 for facilitating the receiving and releasable trapping of a second end 170*b* of the second rib pole 170; and along substantially the remainder of the second end 240 is an enclosure 242 for enclosing at least a substantial length of the second rib pole therein 170.

Lastly, in the preferred embodiment, canopy 200 comprises, at about the middle of a third end 265, a pocket 270 for receiving and trapping a first end 150*a* of the backbone pole 150 and at about the middle of the fourth end 275, an open and closable pocket created in part by a flap 280 for facilitating the receiving and releasable trapping of a second end 150*b* of the backbone pole 150.

In the preferred embodiments, pocket 215, pocket 250 and enclosures 230 and 242 are created primarily through the overlapping of the canopy fabric along respective ends 210, 240 and stitching as illustrated in the figures. However, it is the open and closable pockets created in part by the aforementioned flaps 225, 260, 280 that are but one of the many inventive features disclosed herein and provide for the advantages herein, namely the facilitation of construction and deconstruction of shelter 10. In particular, by providing an opening and closable pocket, such as by the open and closable flaps as disclosed herein, poles 165 and 170 can be slid within the enclosures down to their respective ends whereby respective ends 165*a* and 170*a* are secured within their respective end pocket and, at the other end a closable pocket can be created in part by the respective flaps.

A number of means can be used to secure the respective flap over to create the respective pocket. In the figures and in the preferred embodiment, the means are a Velcro® type arrangement. However, other suitable means are snaps, buttons and zippers just to name a few. Reference numbers 290, 295 are intended to generically indicate the releasable closing means, which may be provided on each side of each flap (and correspondingly located on the canopy underside surface.

Figure 7:
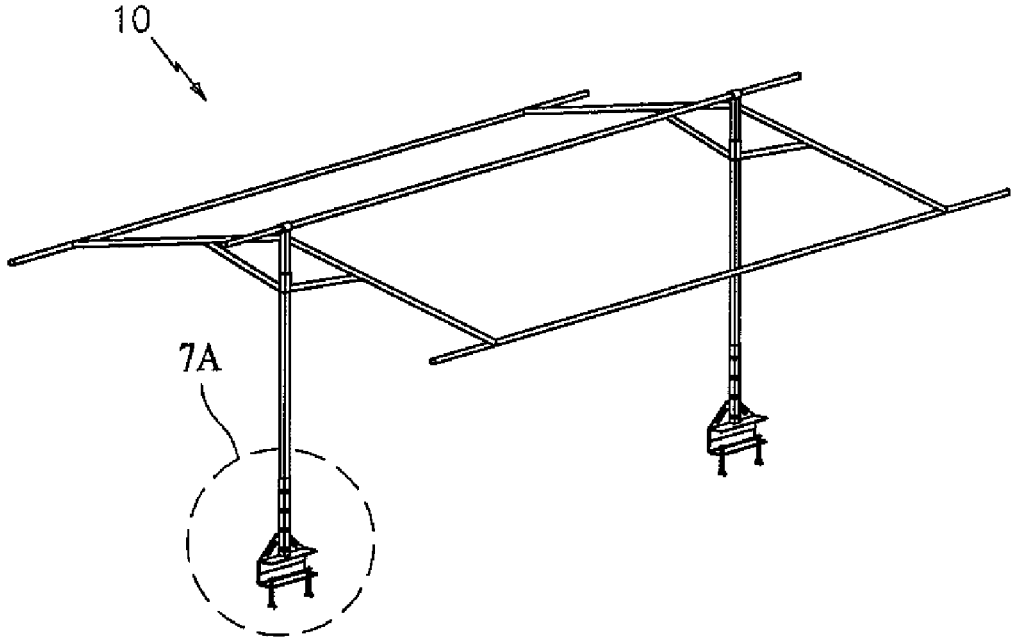
FIGS. 7 and 7A are also perspective views of the portable shelter structure constructed in accordance with a first embodiment of the present invention, with FIG. 7 primarily being illustrated to show the base members in a second orientation and with FIG. 7A being an enlargement of the highlighted section of FIG. 7.
Figure 7A:
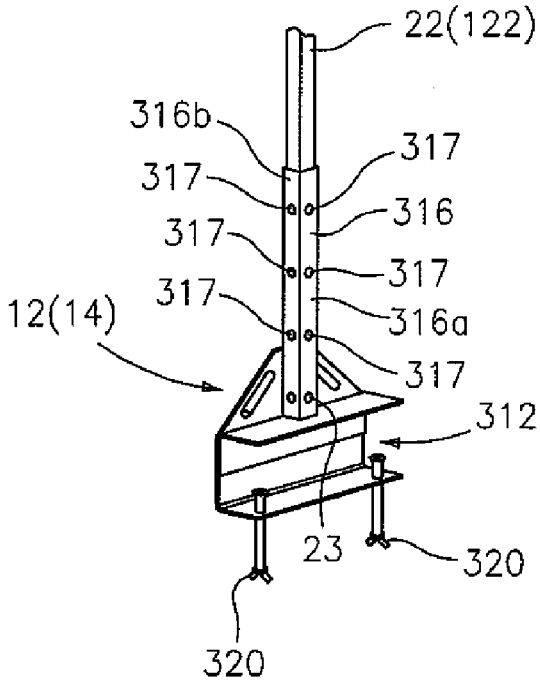

Coupling of the subframe assemblies to the structure (e.g. table, for example a picnic table, a grandstand or tailgate of a small truck) is preferably achieved by base members 12, 14 both of which are preferably identically constructed and exemplified in FIGS. 7, 7A. In a preferred embodiment, each base member comprises a channel 312 (314) formed by sidewalls for receiving a portion of the structure. Each base member also comprises an elongated leg 316 that is coupled, and preferably adjustably coupleable, to its respective vertical support member 22 (122). In the preferred embodiment, both base members are formed of steel sections welded together. A preferred construction provides for a versatile height and orientation adjustability.

In a preferred embodiment, each elongated leg 316 is slideably coupled to its respective vertical support 22 (122). The vertical support member is slideably insertable into the elongated leg, although it should be understood that equally possible is the design where the elongated leg is slideably insertable into its respective vertical support member. As constructed, the elongated leg and the vertical support member have complementary cross-sections, and preferably rectangular, for the slideable insertion therebetween.

In the illustrated and preferred embodiment, the elongated leg has a plurality of apertures 317 spaced apart along at least a first side 316*a* and along a second side 316*b* and wherein the vertical support member 22 (122) comprises a complementary spring-biased pin 23 that is receivable within each of the apertures to releasably lock the position of the elongated leg 316 relative to the vertical support member 22 (122) when the spring-biased pin is within one of the apertures.

In accordance with advantages and objectives of the present invention (and the illustrated embodiments), the elongated leg 316 is releasably coupleable to the vertical support member 22 (122) in at least a first orientation and a second orientation. FIG. 1 illustrates an example of the first orientation achievable by each of the elongated legs wherein the respective channels are in facing alignment so as, for example, to receive a portion of respective sides of a picnic table. On the other hand, FIGS. 7, 5C, 5D illustrate examples of a second orientation achievable by each of the elongated legs wherein the respective channels are positioned 90 degrees from that shown in FIG. 1, so as to be facing in the same direction, for example, to receive a portion of an edge of a grandstand or the tailgate of a truck. In other words, in this second orientation the elongated legs can be mounted on the same side of a structure (i.e. they need not be mounted on opposing sides of the structure, as would be seen in the preferred mounting to the picnic table). This construction provides, among other things, improved versatility as to the uses of the present invention. Bolts or screws 320 or the like may be provided to releasably secure base members 12, 14 to the structure. Apertures to receive the bolts/screws 320 may be provided on the bottom of the channel as illustrated in FIG. 7A and/or on top of the channel. More or less than two securing means 320 may be provided per base member. It should thus be clear that when discussing "orientation" it is the facing (or rotatability of the facing) alignment of the base members.

What is yet another feature of the present invention is the ability to provide shelter next to or proximate the structure to which the portable shelter structure is mounted or coupled. Specifically, as disclosed above, a preferred embodiment provides that first coupling arrangement includes respective clamps (e.g. reference number 72) so that backbone pole 150 can slide therethrough. And, as disclosed above and illustrated herein, pole supporters 162, 164, 172, 174 are preferably of the "ring-type" thereby permitting the rib poles to slide therein. In this way, the distance between subframe assembly 20 and subframe assembly 120 can be adjusted so that differing size structures (e.g. tables) can be accommodated. Also however, such an arrangement can provide for an adjustability and providability of shelter next to or proximate the structure, as illustrated in FIG. 5B. In this way, babies, baby strollers, food items or the like can also be provided with shelter along with the structure itself. This feature also provides an advantage and objective over those structures in the prior art.

In view of the foregoing, construction of the present invention should be understood by those skilled in the art. For example, the preferred method is to first construct the shelter by assembling the subframe assemblies, inserting the respective poles and coupling the canopy thereto and then thereafter, popping the structure (i.e. moving the second coupling arrangement 80 towards the second end 26 (126) of the respective vertical support members 22 (122)). In the preferred embodiment, second coupling arrangement 80 remains in its raised position by the coordinated use of an aperture 87 in the molded part 80 and a spring-biased pin 27 coupled to each vertical support member 22, 122 that is receivable within aperture 87 to releasably lock the position of the second coupling arrangement 80 relative to the vertical support member 22 (122).

It can thus be seen that the present invention is advantageous and overcomes perceived deficiencies in the prior art. For example, the present invention provides an improved portable shelter structure that can be mounted or coupled on and/or to a variety of structures, such as for example and not limitation, a picnic table, a grandstand and a tailgate of a truck. The present invention also allows for relatively quick assembly and disassembly for the reasons noted above, and is relatively lightweight yet durable due to much of the structure e.g. (base members, vertical support members, arm members, brace members) being comprised of powder coated hollow steel tubing along with polymer being used for components such as the first coupling arrangement and second coupling arrangement. The poles are preferably made from tubular steel. The present invention is both easy to utilize, build and manufacture due to a variety of reasons, one of which is the disclosed component assembly, such as for the poles themselves. As such, the present invention can be transported and/or shipped rather easily in view of the construction of the canopy supporting assembly. Additionally, the present invention provides for improved vertical adjustability and canopy attachment construction. Still further, the present invention provides an adjustable amount of shelter (e.g. cover) next to or otherwise proximate the structure to/on which it is mounted or (e.g.) coupled, as disclosed above. And finally but not exhaustively, the present invention provides an improved portable shelter structure that can be mounted or coupled to structures of varying sizes, such as for example and not limitation, picnic tables of many sizes and even possibility shapes, as would now be understood from the foregoing.

It will thus be seen that the objects set forth above, among those made apparent from the preceding description, are efficiently attained and, since certain changes may be made in the above constructions without departing from the spirit and scope of the invention, it is intended that all matter contained in the above description or shown in the accompanying drawings shall be interpreted as illustrative and not in a limiting sense.

It should also be understood that the following claims are intended to cover all of the generic and specific features of the invention described herein and all statements of the scope of the invention that as a matter of language might fall there between.

What is claimed is:

1. A portable shelter for providing cover over an area, wherein the shelter is coupleable to a structure, the portable shelter comprising:

a first base member and a second base member, each of which are coupleable to the structure;

two subframe assemblies, each subframe assembly comprising:

a vertical support member having a first end and a second end, wherein the first end is coupleable to a respective base member;

at least two arm members, each having a first end and a second end, wherein the first end of each respective arm member is pivotally coupled to the second end of vertical support member;

at least two brace members, each having a first end and a second end, each respective first end being coupled to the vertical support member and each respective second end being pivotably coupled to a respective arm member;

a first coupling arrangement for pivotably coupling the respective first end of each arm member to the second end of the vertical support member;

a second coupling arrangement, slideably coupled to the vertical support member, for coupling the respective first end of each brace member to the vertical support member, a canopy;

a canopy supporting assembly coupled to the two subframe assemblies, wherein the canopy supporting assembly supports the canopy and provides cover over the area, wherein the canopy supporting assembly comprises:

a first rib pole and a second rib pole, a first rib pole supporter coupled to the second end of the first arm member of the first subframe assembly;

a second rib pole supporter coupled to the second end of the first arm member of the second subframe assembly;

a third rib pole supporter coupled to the second end of the second arm member of the first subframe assembly; and a fourth rib pole supporter coupled to the second end of the second arm member of the second subframe assembly;

wherein the first rib pole is supported by the first and second rib pole supporters and the second rib pole is supported by the third and fourth rib pole supporters; and wherein the canopy is substantially rectangular in shape and comprises:

at one corner of a first end, a pocket for receiving and trapping a first end of the first rib pole;

at the other corner of the first end, an open and closable pocket for facilitating the receiving and releasable trapping of a second end of the first rib pole; and along substantially the remainder of the first end, an enclosure for enclosing at least a substantial length of the first rib pole therein.

2. The portable shelter as claimed in claim 1, wherein the canopy comprises:

at one corner of a second end, a pocket for receiving and trapping a first end of the second rib pole;

at the other corner of the second end, an open and closable pocket for facilitating the receiving and releasable trapping of a second end of the second rib pole;

along substantially the remainder of the second end, an enclosure for enclosing at least a substantial length of the second rib pole therein.

3. The portable shelter as claimed in claim 2, wherein the canopy supporting assembly comprises at least a backbone pole, and wherein the canopy comprises:

at about the middle of a third end, a pocket for receiving and trapping a first end of the backbone pole;

at about the middle of a fourth end, an open and closable pocket for facilitating the receiving and releasable trapping of a second end of the backbone pole.

4. A portable shelter for providing cover over an area, wherein the shelter is coupleable to a structure, the portable shelter comprising:

a first base member and a second base member, each of which are coupleable to the structure and wherein each base member comprises (i) a channel for receiving a portion of the structure and (ii) an elongated leg;

two subframe assemblies, each subframe assembly comprising:

a vertical support member having a first end and a second end, wherein the first end is coupleable to a respective base member;

at least two arm members, each having a first end and a second end, wherein the first end of each respective arm member is pivotally coupled to the second end of vertical support member;

at least two brace members, each having a first end and a second end, each respective first end being coupled to the vertical support member and each respective second end being pivotably coupled to a respective arm member;

a first coupling arrangement for pivotably coupling the respective first end of each arm member to the second end of the vertical support member;

a second coupling arrangement, slideably coupled to the vertical support member, for coupling the respective first end of each brace member to the vertical support member, a canopy supporting assembly coupled to the two subframe assemblies, wherein the canopy supporting assembly supports a canopy and provides cover over the area wherein at least:

the elongated leg associated with the first base member is slideably coupled to the vertical support member associated with a first of the two subframe assemblies and the elongated leg associated with the second base member is slideably coupled to the vertical support member associated with a second of the two subframe assemblies, one of the elongated leg associated with the first base member and the vertical support member associated with the first of the two subframe assemblies is slideably insertable into the other of the elongated leg associated with the first base member and the vertical support member associated with the first of the two subframe assemblies, wherein the elongated leg associated with the first base member and the vertical support member associated with the first of the two subframe assemblies have complementary rectangular cross-sections for the slideable insertion therebetween; and wherein one of the elongated leg associated with the first base member and the vertical support member associated with the first of the two subframe assemblies has a plurality of apertures spaced apart along at least a first side and along a second side and wherein the other of the elongated leg associated with the first base member and the vertical support member associated with the first of the two subframe assemblies comprises a complementary spring-biased pin that is receivable within each of the apertures to releasably lock the position of the elongated leg associated with the first base member relative to the vertical support member associated with the first of the two subframe assemblies when the spring-biased pin is within one of the apertures; and wherein the elongated leg associated with the first base member is releasably coupleable to the vertical support member associated with the first of the two subframe assemblies in at least a first orientation and a second orientation;

wherein:

the elongated leg associated with the first base member and the vertical support member associated with the first of the two subframe assemblies is in the first orientation when the spring-biased pin is received within an aperture along the first side, and the elongated leg associated with the first base member and the vertical support member associated with the first of the two subframe assemblies is in the second orientation when the spring-biased pin is received within an aperture along the second side.

* * * * *